US008303429B2

(12) United States Patent
Cackett et al.

(10) Patent No.: US 8,303,429 B2
(45) Date of Patent: Nov. 6, 2012

(54) GOLF CLUB WITH STABLE FACE ANGLE

(75) Inventors: Matthew T. Cackett, San Diego, CA (US); Alan Hocknell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 553 days.

(21) Appl. No.: 12/692,447

(22) Filed: Jan. 22, 2010

(65) Prior Publication Data

US 2011/0039637 A1 Feb. 17, 2011

Related U.S. Application Data

(60) Provisional application No. 61/147,552, filed on Jan. 27, 2009.

(51) Int. Cl.
*A63B 53/04* (2006.01)

(52) U.S. Cl. ..... 473/246; 473/248; 473/328; 473/345

(58) Field of Classification Search ..... 473/324–350
See application file for complete search history.

(56) References Cited

U.S. PATENT DOCUMENTS

| | | | | |
|---|---|---|---|---|
| 782,955 | A | 2/1905 | Emens | |
| 796,802 | A | 8/1905 | Brown | |
| 1,454,267 | A | 5/1923 | Challis et al. | |
| D63,284 | S | 11/1923 | Challis | |
| 1,623,523 | A | 4/1927 | Bourke | |
| 1,650,183 | A | 11/1927 | Brooks | |
| 1,890,538 | A | 12/1932 | Hadden | |
| 1,895,417 | A | 1/1933 | Lard | |
| 1,946,134 | A | 2/1934 | Dyce | |
| 2,020,679 | A | 11/1935 | Fitzpatrick | |
| 2,219,670 | A | 10/1940 | Wettlaufer | |
| 2,225,931 | A | 12/1940 | Sexton | |
| 2,464,850 | A | 3/1949 | Crawshaw | |
| 3,424,459 | A | 1/1969 | Evancho | |
| 3,524,646 | A | 8/1970 | Wheeler | |
| 3,815,921 | A * | 6/1974 | Turner | 473/328 |
| 3,829,092 | A | 8/1974 | Arkin | |
| 3,840,231 | A | 10/1974 | Moore | |
| 3,848,737 | A | 11/1974 | Kenon | |

(Continued)

FOREIGN PATENT DOCUMENTS

GB 2207358 2/1989

(Continued)

OTHER PUBLICATIONS

Ellis, Jeffrey B., The Clubmaker's Art: Antique Golf Clubs and Their History, Second Edition Revised and Expanded, vol. II, 2007, p. 485.

(Continued)

*Primary Examiner* — Alvin Hunter
(74) *Attorney, Agent, or Firm* — Michael A. Catania; Rebecca Hanovice; Sonia Lari

(57) ABSTRACT

A golf club having a golf club head 20 with a keel zone that makes the actual face angle of the golf club appear differently when the golf club is at address. The golf club head 20 has a keel zone that is preferably 0.5 inch wide in the fore-aft direction and 1.0 inch wide in the heel-toe direction, which changes the appearance of the face angle while the golf club is at address.

9 Claims, 7 Drawing Sheets

U.S. PATENT DOCUMENTS

| | | | | |
|---|---|---|---|---|
| 3,891,212 | A | 6/1975 | Hill | |
| 3,893,670 | A | 7/1975 | Franchi | |
| 4,253,666 | A | 3/1981 | Murphy | |
| 4,306,721 | A | 12/1981 | Doyle | |
| 4,340,227 | A | 7/1982 | Dopkowski | |
| 4,506,888 | A | 3/1985 | Nardozzi, Jr. | |
| 4,664,382 | A | 5/1987 | Palmer et al. | |
| 4,804,184 | A | 2/1989 | Maltby | |
| 4,852,782 | A | 8/1989 | Wu et al. | |
| 4,854,582 | A | 8/1989 | Yamada | |
| 4,895,368 | A | 1/1990 | Geiger | |
| 4,943,059 | A | 7/1990 | Morell | |
| 4,948,132 | A | 8/1990 | Wharton | |
| 5,039,098 | A | 8/1991 | Pelz | |
| 5,133,553 | A | 7/1992 | Divnick | |
| 5,178,394 | A | 1/1993 | Tanampai | |
| 5,255,914 | A | 10/1993 | Schroder | |
| 5,275,408 | A | 1/1994 | Desbiolles et al. | |
| 5,280,923 | A | 1/1994 | Lu | |
| 5,333,862 | A | 8/1994 | Teramoto | |
| 5,433,442 | A | 7/1995 | Walker | |
| 5,513,844 | A | 5/1996 | Ashcraft et al. | |
| 5,533,725 | A | 7/1996 | Reynolds, Jr. | |
| 5,540,435 | A | 7/1996 | Kawasaki | |
| 5,542,666 | A | 8/1996 | Chou | |
| 5,588,921 | A | 12/1996 | Parsick | |
| 5,626,528 | A | 5/1997 | Toulon | |
| 5,653,645 | A | 8/1997 | Baumann | |
| 5,688,188 | A | 11/1997 | Chappell | |
| 5,702,310 | A | 12/1997 | Wozny | |
| 5,722,901 | A | 3/1998 | Barron et al. | |
| 5,749,790 | A | 5/1998 | Van Alen, II et al. | |
| 5,839,973 | A | 11/1998 | Jackson | |
| 5,863,260 | A | 1/1999 | Butler, Jr. et al. | |
| 5,931,742 | A | 8/1999 | Nishimura et al. | |
| 5,951,411 | A | 9/1999 | Wood et al. | |
| 6,039,659 | A | 3/2000 | Hamm | |
| 6,110,055 | A | 8/2000 | Wilson | |
| 6,120,384 | A | 9/2000 | Drake | |
| 6,149,533 | A | 11/2000 | Finn | |
| 6,251,028 | B1 | 6/2001 | Jackson | |
| 6,270,425 | B1 | 8/2001 | Dyer | |
| 6,273,828 | B1 | 8/2001 | Wood et al. | |
| 6,287,214 | B1 | 9/2001 | Satoh | |
| 6,352,483 | B1 | 3/2002 | Okoshi | |
| 6,368,230 | B1 | 4/2002 | Helmstetter et al. | |
| 6,371,865 | B1 | 4/2002 | Magliulo | |
| 6,371,866 | B1 | 4/2002 | Rivera | |
| 6,447,404 | B1 | 9/2002 | Wilbur | |
| 6,475,100 | B1 | 11/2002 | Helmstetter et al. | |
| 6,478,691 | B2 | 11/2002 | Okoshi | |
| 6,514,154 | B1 | 2/2003 | Finn | |
| 6,547,673 | B2 | 4/2003 | Roark | |
| 6,620,053 | B2 | 9/2003 | Tseng | |
| 6,634,957 | B2 | 10/2003 | Tseng | |
| 6,669,573 | B2 | 12/2003 | Wood et al. | |
| 6,746,341 | B1 | 6/2004 | Hamric, Jr. et al. | |
| 6,764,413 | B2 | 7/2004 | Ho | |
| 6,769,994 | B2 | 8/2004 | Boone | |
| 6,769,996 | B2 | 8/2004 | Tseng | |
| RE38,605 | E | 9/2004 | Kubica et al. | |
| 6,789,304 | B2 | 9/2004 | Kouno | |
| 6,857,969 | B2 | 2/2005 | Rice | |
| 6,890,269 | B2 | 5/2005 | Burrows | |
| 6,899,636 | B2 | 5/2005 | Finn | |
| 6,926,616 | B1 | 8/2005 | Kusumoto et al. | |
| 6,964,617 | B2 | 11/2005 | Williams | |
| 6,966,847 | B2 | 11/2005 | Lenhof et al. | |
| 6,997,818 | B2 | 2/2006 | Kouno | |
| 7,014,569 | B1 | 3/2006 | Figgers | |
| 7,083,529 | B2 | 8/2006 | Cackett et al. | |
| 7,115,046 | B1 | 10/2006 | Evans | |
| 7,163,468 | B2 * | 1/2007 | Gibbs et al. | 473/329 |
| 7,241,229 | B2 | 7/2007 | Poynor | |
| 7,273,419 | B2 * | 9/2007 | Evans et al. | 473/328 |
| 7,281,985 | B2 | 10/2007 | Galloway | |
| 7,300,359 | B2 | 11/2007 | Hocknell et al. | |
| 7,326,126 | B2 | 2/2008 | Holt et al. | |
| 7,335,113 | B2 | 2/2008 | Hocknell et al. | |
| 7,344,449 | B2 | 3/2008 | Hocknell et al. | |
| 7,377,862 | B2 | 5/2008 | Galloway | |
| 7,387,577 | B2 | 6/2008 | Murphy et al. | |
| 7,399,237 | B2 * | 7/2008 | Evans et al. | 473/328 |
| 7,410,426 | B2 | 8/2008 | Willett et al. | |
| 7,427,239 | B2 | 9/2008 | Hocknell et al. | |
| 7,465,239 | B2 | 12/2008 | Hocknell et al. | |
| 7,476,160 | B2 | 1/2009 | Hocknell et al. | |
| D588,661 | S | 3/2009 | Lee | |
| D588,662 | S | 3/2009 | Lee | |
| D588,663 | S | 3/2009 | Lee | |
| D588,664 | S | 3/2009 | Lee | |
| 7,699,717 | B2 | 4/2010 | Morris et al. | |
| 7,846,041 | B2 | 12/2010 | Beach et al. | |
| 7,934,999 | B2 * | 5/2011 | Cackett et al. | 473/242 |
| 8,012,034 | B1 * | 9/2011 | Cackett et al. | 473/242 |
| 8,123,626 | B2 * | 2/2012 | Cackett et al. | 473/242 |
| 8,221,258 | B2 * | 7/2012 | Cackett et al. | 473/242 |
| 8,262,496 | B1 * | 9/2012 | Cackett et al. | 473/242 |
| 2001/0007835 | A1 | 7/2001 | Baron | |
| 2002/0037773 | A1 | 3/2002 | Wood et al. | |
| 2003/0008723 | A1 | 1/2003 | Goodman | |
| 2004/0018886 | A1 | 1/2004 | Burrows | |
| 2004/0018887 | A1 | 1/2004 | Burrows | |
| 2004/0063515 | A1 | 4/2004 | Boone | |
| 2005/0049067 | A1 | 3/2005 | Hsu | |
| 2005/0049072 | A1 | 3/2005 | Burrows | |
| 2005/0079923 | A1 | 4/2005 | Droppleman | |
| 2006/0287125 | A1 | 12/2006 | Hocknell et al. | |
| 2007/0099719 | A1 | 5/2007 | Halleck et al. | |
| 2007/0117645 | A1 | 5/2007 | Nakashima | |
| 2007/0254746 | A1 | 11/2007 | Poynor | |
| 2007/0265106 | A1 | 11/2007 | Burrows | |
| 2008/0058114 | A1 | 3/2008 | Hocknell et al. | |
| 2008/0076590 | A1 | 3/2008 | Hsu | |
| 2008/0119301 | A1 | 5/2008 | Holt et al. | |
| 2008/0254908 | A1 | 10/2008 | Bennett et al. | |
| 2008/0280693 | A1 | 11/2008 | Chai | |
| 2009/0011848 | A1 | 1/2009 | Thomas et al. | |
| 2009/0011849 | A1 | 1/2009 | Thomas et al. | |
| 2009/0011850 | A1 | 1/2009 | Stites et al. | |
| 2009/0062029 | A1 | 3/2009 | Stites et al. | |
| 2009/0143167 | A1 | 6/2009 | Evans | |
| 2010/0292018 | A1 | 11/2010 | Cackett et al. | |

FOREIGN PATENT DOCUMENTS

| | | |
|---|---|---|
| GB | 2225725 A | 6/1990 |
| GB | 2241173 | 8/1991 |
| JP | 4156869 | 5/1992 |
| JP | 8318008 | 12/1996 |
| JP | 9164227 | 6/1997 |
| JP | 2000005349 | 1/2000 |
| JP | 2003062131 | 3/2003 |
| JP | 2006042951 | 2/2006 |
| TW | 139608 | 8/1990 |
| WO | WO2004009186 | 1/2004 |
| WO | WO2006055386 | 5/2006 |

OTHER PUBLICATIONS

"Mickey Finn T-Bar Putter—The Mickey Finn Golf Putter," Oct. 20, 2004 (http://www.mickeyfinngolf.com/Default/asp) (1 page).

"Charles A. "Mickey" Finn, Mickey Finn Tom Clancy The Cardinal of the Kremlin," Oct. 20, 2004 (http://www.mickeyfinngolf.com/mickeyfinngolf.asp) (2 pages).

"Mickey Finn M-2 T-Bar Putter & Mickey Finn M-3 T-Bar Putter," Oct. 20, 2004 (http://www.mickeyfinngolf.com/putters.asp) (3 pages).

* cited by examiner

GOLF CLUB WITH STABLE FACE ANGLE

CROSS REFERENCES TO RELATED APPLICATIONS

The present application claims priority to U.S. Provisional Patent Application No. 61/147,552, filed on Jan. 27, 2009, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a golf club with a golf club head having a single keel point. More specifically, the present invention relates to a golf club having a golf club head with a single keel point and a stable face angle.

2. Description of the Related Art

Appearance is everything. This is especially true when it comes to the appearance of a golf club at address. Perceived face angle affects marketability as some golfers are very sensitive to the look of an "open" or especially "closed" club face at address, and this factor may weigh heavily in a purchase decision. Some golfers will not even try a golf club that has a face angle they consider unappealing, regardless of the performance of the club.

The face angle of a golf club is defined as the angle of the face to the grounded sole line with the shaft hole perpendicular to the line of flight. Maltby, *Golf Club Design, Fitting, Alteration, & Repair, The Principles & Procedures,* 4$^{th}$ Edition, Ralph Maltby Enterprises, (1995). The perceived face angle is different than the measured face angle as would be measured on a device such as a CMM or De La Cruz gage. The measured face angle is based on the orientation of the face normal vector at a point in the center of the face. The perceived face angle is generally influenced by factors such as head outline shape at address and paint edge along the top of the face.

Alternative solutions to overcome the problem of variability of face angle at address include use of a dual keel point or multi-keel point sole shape, however these sole shapes have undesired affects on styling and on sound from striking the ball. Other inventions that allow for adjustments in the lie angle and face angle are also available. One such example is Callaway Golf, U.S. Pat. No. 7,281,985 for a Golf Club Head. The Callaway patent describes a golf club head which allows for the face angle, lie angle, loft angle, and shaft diameter of the golf club to be customized to a golfer. The customization of the face angle is accomplished by providing a golf club head with an insert for orientation of the golf club face angle following the manufacture of the golf club head.

Another example is Ralph Maltby Enterprises, Inc, U.S. Pat. No. 480,484 for Method of Fitting Golf Club to Golfer, which discloses the use of a soleplate which discloses a spherical roll sole toward the toe of a head and a runner toward the heel of the head. The face angle can be adjusted by grinding the runner to slope toward or away from the ball striking face of the head.

A further example is The Yokohama Rubber Co. Ltd., U.S. Pat. No. 5,333,862, for a Wood Type Golf Club. The Yokohama patent discloses ideal ranges of angles for the face angle, lie angle, and angle of center of gravity, such that having a combination of such angles reduces the slice effect.

A further example is Callaway Golf, U.S. Pat. No. 6,475,100 for a Golf Club Head with Adjustable Face Angle. The Callaway Golf patent discloses a club head with an internal hosel and an insert disposed within that internal hosel. The insert allows for the face angle of the golf club to be oriented after manufacturing of the golf club head.

Yet a further example is Callaway Golf, U.S. Pat. No. 6,964,617 for a golf club head with gasket. This patent discloses a golf club head with a gasket. The gasket controls the face angle of the club head. The width of the gasket varies to provide an open face angle club head, a closed face angle club head, or a neutral face angle club head.

Still another example is Callaway Golf, U.S. Pat. No. 7,377,862 for a method for fitting a golf club. The Callaway patent discloses a golf club head that has different hosel section orientations which allow for different face angles.

Woods, and in particular drivers, have historically been designed such that the sole shape (surface contour) is defined for styling or turf interaction purposes. Further, the center of gravity has been positioned in a location relative to the face in order to preferentially affect trajectory of the golf ball. The relationship between the sole shape and center of gravity of the golf club determines the face angle at address (natural sole) for a sole shape having a single contact point at equilibrium. This relationship has not been fully understood and as a result the face angle at address may often be different than intended in the design model. Some golfers are very sensitive to the look of an "open" or especially "closed" club face at address and this factor may weigh heavily in a purchase decision.

The club head design in CAD may orient the head in CAD space such that the face angle is at the desired value. This orientation is arbitrarily constrained and is not necessarily representative of the orientation when a player addresses the club and allows it to find an equilibrium orientation.

Some wood heads may overcome this limitation by use of a dual keel point or multi-keel point sole shape. Sole shapes of this type often have undesired affects on styling and on sound from striking a ball.

As a driver is rotated thru a range of address lie angles the measured face angle will generally change by an amount related to the loft of the face at initial orientation and the range of lie angles rotated thru. For instance, a driver having a 10 degrees loft and 0 degree face angle (also known as "Square") at a design lie angle of 56 degrees, will have a measured face angle that changes significantly (see FIG. 11) as address lie angle changes from 56 degrees to 40 degrees. This change in measured face angle is generally not perceived by the golfer as it doesn't result in rotation of the club head about a vertical axis. This behavior is widely considered desirable as it provides a consistent "looking" club at address for a wide range of players who may have different lie angles at address.

However, depending on the relative orientation of the club center of gravity ("CG") and the sole surface in the vicinity of contact with the ground, the measured and perceived face angles may vary unexpectedly at different address lie angles. This is a problem with many current woods which can result in problems with acceptance in the market place. Some golfers won't even try a club that has a face angle they consider unappealing, regardless of the performance of the club. An example of the face angle behavior of such a club is shown in FIG. 12.

It is apparent that the need exists for a golf club head with a stable face angle. Golfers want a golf club with an appealing face angle while golf equipment manufacturers need to provide as much standardization as possible in order to prevent escalation of manufacturing costs. Therefore, although prior art has presented many inventions for providing customization, the prior art has failed to provide a cost effective method for customization.

BRIEF SUMMARY OF THE INVENTION

The present invention seeks to overcome the variability and uncertainty of face angle at address (natural sole) for a wood having a single keel point. Further, the club head design seeks to provide the intended perceived face angle regardless of the lie angle at which the player addresses the club, within a range of 40-55 degrees.

The present invention allows for a golf club head with a keel zone that affects the appearance of the face angle of the golf club. For example, the golf club has a measured face angle that changes significantly as lie angles change from 40 degrees to 60 degrees. However, because of the keel zone, the measured face angle is not perceived by the golfer as there is no rotation of the club head.

One aspect of the present invention is a golf club head. The golf club head includes a body and a keel zone. The body has a front portion, a crown portion and a sole portion. The body also has a heel end, a toe end and an aft end. The sole portion has a single keel point. The keel zone is located in the sole portion. The keel zone is located in the fore-aft direction by the equilibrium line. The keel zone is located in the heel-toe direction by the target lie angle. The keel zone preferably has a width of 0.50 inch in the fore-aft direction and 1.00 inch in the heel-toe direction.

Another aspect of the present invention is a golf club. The golf club includes a golf club head, a keel zone and a shaft. The golf club head includes a body having a front portion, a crown portion and a sole portion. The body also has a heel end, a toe end and an aft end. The sole portion has a single keel point. The keel zone is located in the fore-aft direction by the equilibrium line. The keel zone is located in the heel-toe direction by the target lie angle. The size of the keel zone is preferably 0.5 inch wide in the fore-aft direction and 1.0 inch wide in the heel-toe direction. The shaft is connected to the golf club head. The equilibrium line is defined as a line that runs from a point on the underside of the grip five inches below the butt end of the shaft through the club center of gravity and extending through the club head.

The golf club head preferably has a volume ranging from 200 cubic centimeters to 600 cubic centimeters, more preferable from 300 cubic centimeters to 500 cubic centimeters, and most preferably from 350 cubic centimeters to 480 cubic centimeters.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 10:
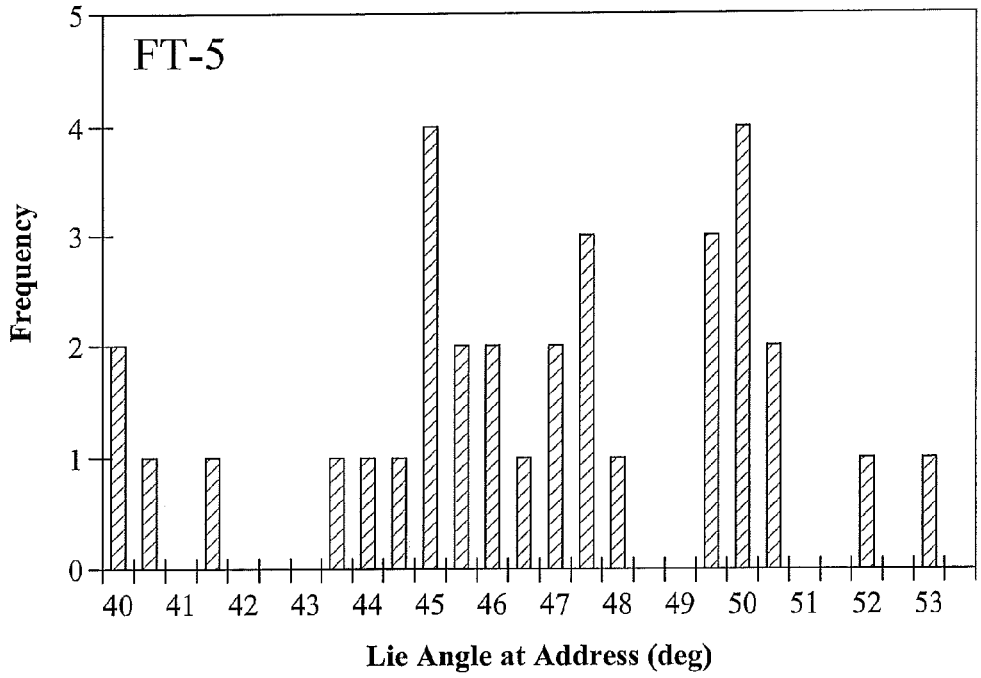
FIG. 10 is a chart illustrating the frequency distribution of lie angles at address for various golfers using the same standard driver having a golf club length of 46 inches.
Figure 11:
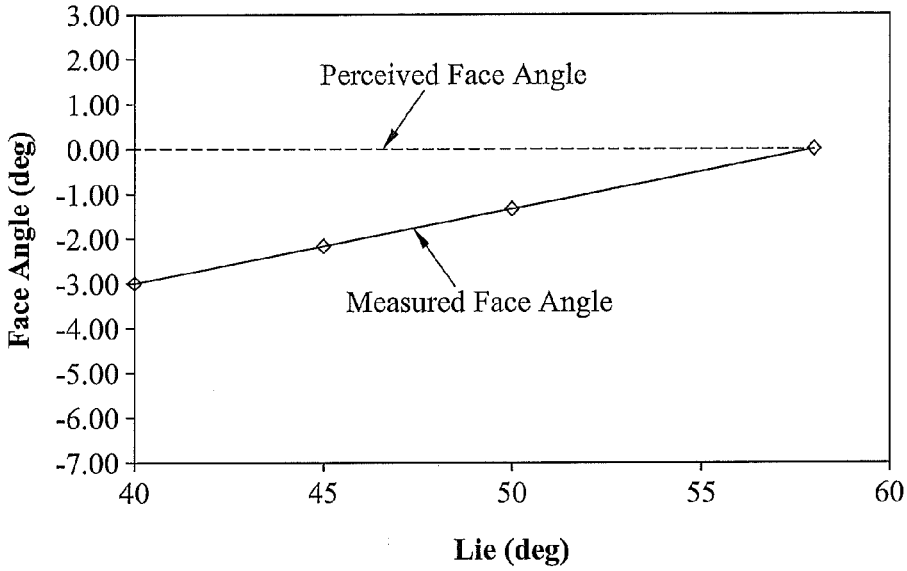
FIG. 11 is a graph showing ideal measured face angles and perceived face angles at various lie angles ranging from 40 to 60 degrees.
Figure 12:
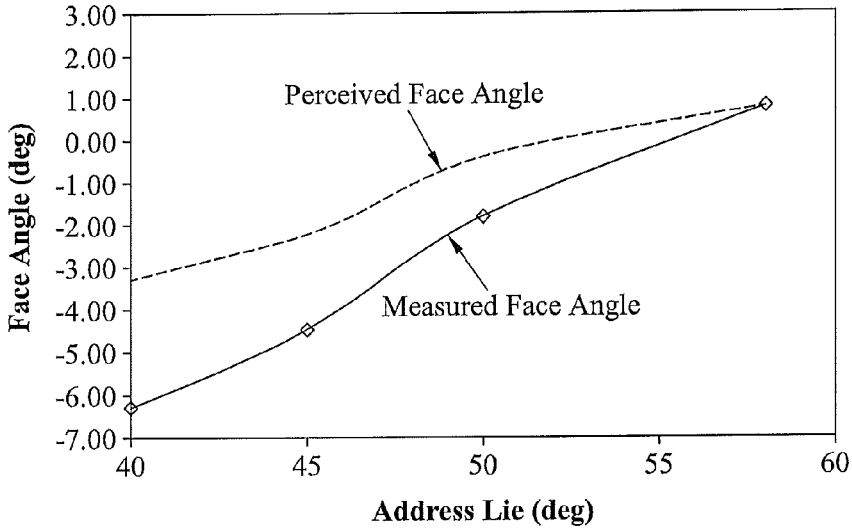
FIG. 12 is a graph showing actual measured face angles and perceived face angles at various lie angles ranging from 40 to 60 degrees.

The address lie angle may be very different for different golfers as shown in FIG. 10. As a result, if the design intent is for the club to appear to have the same face angle for all golfers it must be stable over a wide range of address lie angles.

Figure 9:
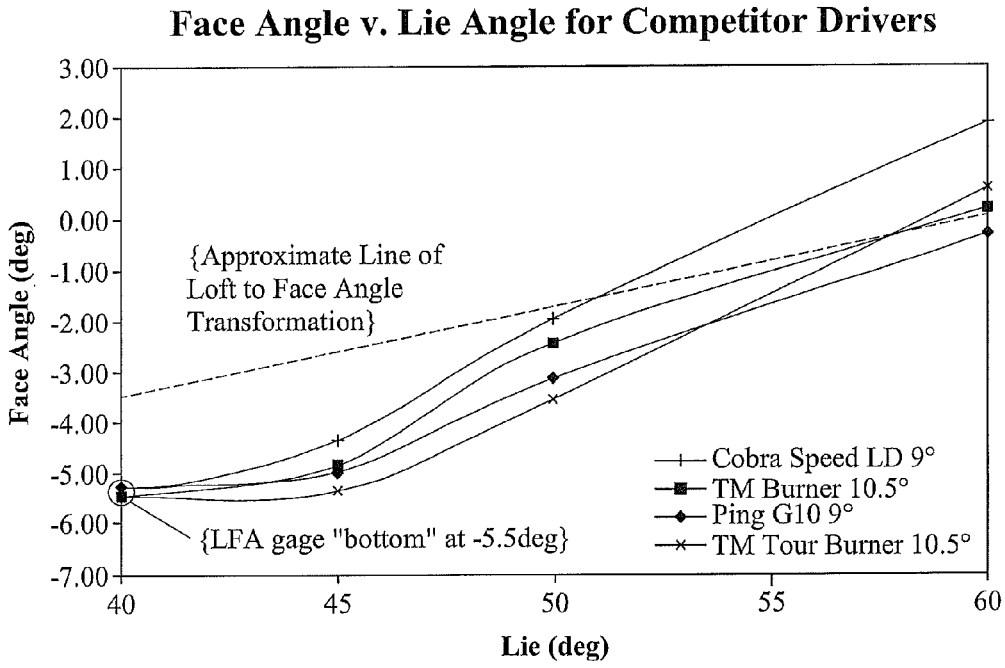
FIG. 9 is a graph showing measured face angles for various golf clubs at various lie angles ranging from 40 to 60 degrees.

As shown in FIG. 9, a survey of competitor drivers exhibit the undesirable behavior of excessive variation in face angle at different address lie angles.

The sole surface within a defined proximity of the natural sole keel point ("keel zone") is such that even if the club is addressed at different lie angles (40-60 degrees) the resulting perceived face angle will be constant within +/−0.5 degrees.

The "line of equilibrium" is preferably defined as a line that runs from a point on the underside of the grip at five inches below the butt end thru the club center of gravity and extending thru the head. The keel zone is defined relative to this line.

Figure 5:
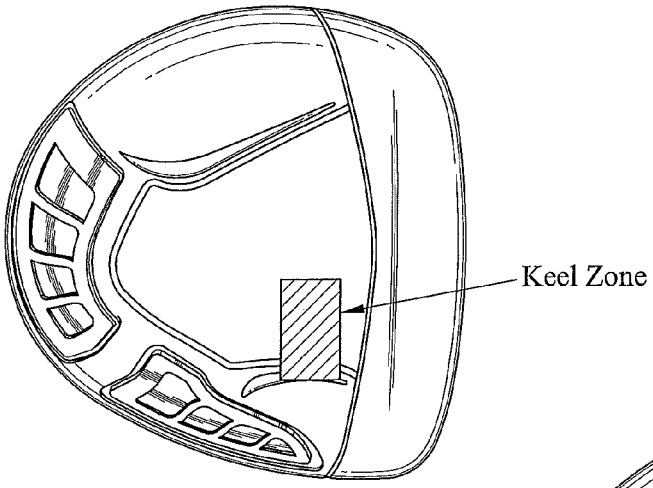
FIG. 5 is a bottom plan view of a golf club head illustrating a keel zone.
Figure 6:
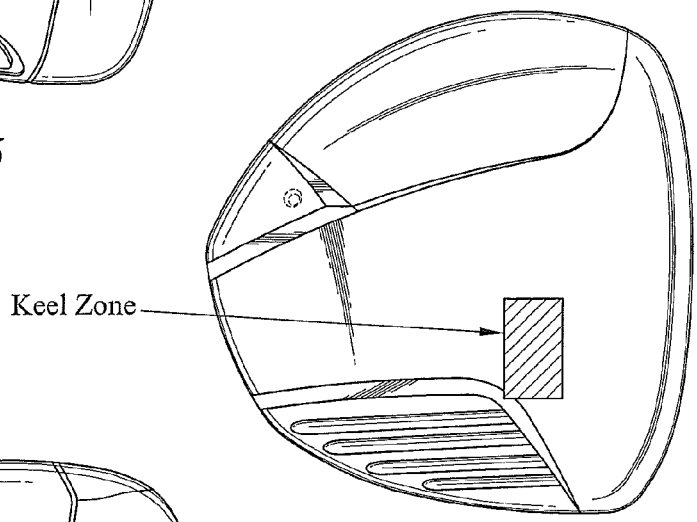
FIG. 6 is a bottom plan view of a golf club head illustrating a keel zone.
Figure 7:
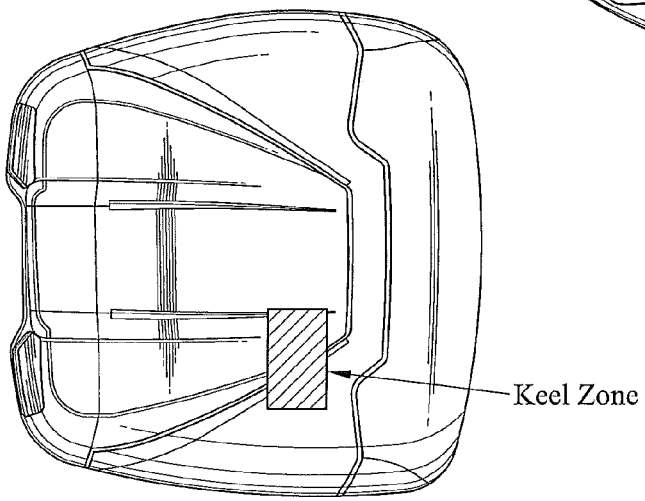
FIG. 7 is a bottom plan view of a golf club head illustrating a keel zone.
Figure 8:
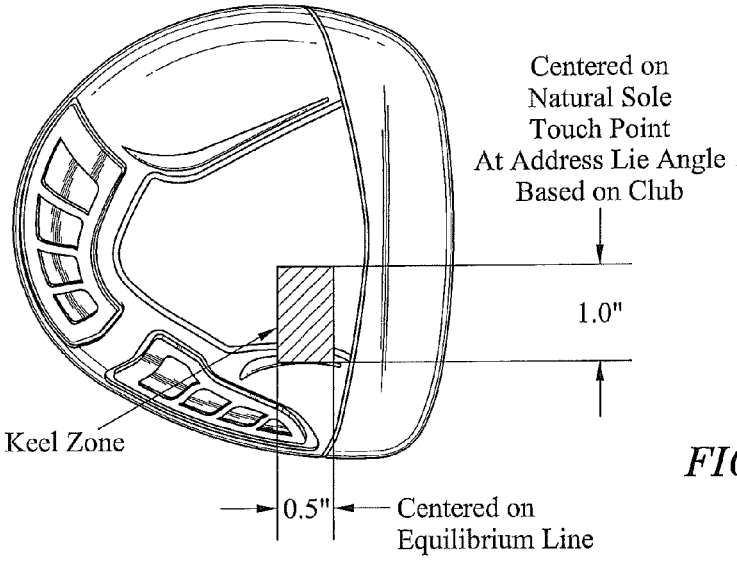
FIG. 8 is a bottom plan view of a golf club head illustrating a keel zone and providing a definition of the keel zone.

As shown in FIGS. 5-7, the present invention is a club head with a keel zone, defined as a local prismatic surface on the sole of a club head. The keel zone surface is prismatic to the "X" axis which is oriented in the fore-aft (front-back) direction of the head at nominal design orientation. The keel zone is located in the fore-aft direction by the "equilibrium line" described in the previous section. The keel zone is located in the heel-toe direction by the target lie angle as defined in Table 1. The center of the keel zone contacts the ground at the target lie angle and the zone is equally dispersed about the contact point in the heel and toe directions. The size of the keel zone is preferably 0.5 inch wide fore-aft and 1.0 inch wide heel-toe as measured when viewed from along the vertical axis. The keel zone surface is within 0.05 inch of this definition across the full extent of the surface.

This invention describes a keel zone on the sole of a club head located preferentially with respect to the club CG. Within this local prismatic surface the club head will contact the ground for any of a wide range of practical orientations (lie angles) at address. This causes the club to appear to have a stable face angle even when addressed at different lie angles.

As shown in FIGS. 1-4, a golf club head of the present invention is generally designated 20. The golf club head has a body, which preferably includes a crown portion 24, a sole portion 26, a ribbon portion 28, a front wall 30 and a hollow interior. The golf club head 20 has a heel end 36, a toe end 38, a fore end and an aft end 37.

Figure 13:
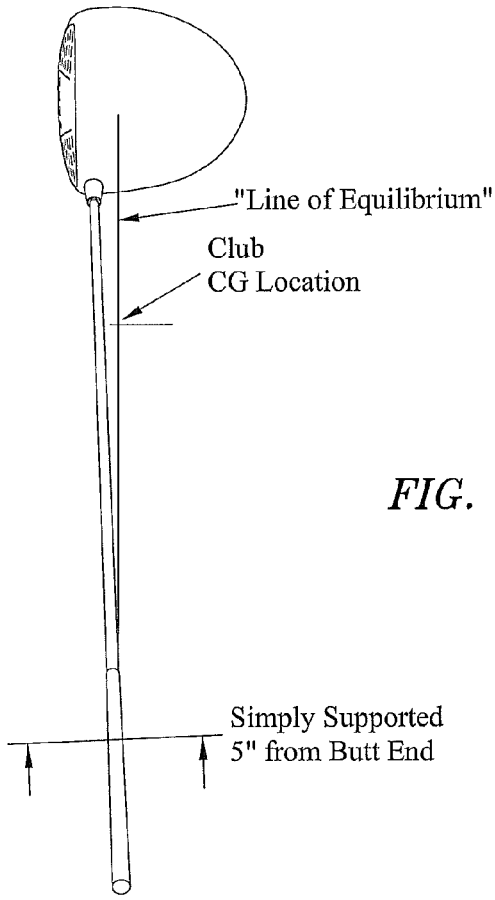
FIG. 13 is a top plan view of a golf club to illustrate the line of equilibrium.

As shown in FIG. 13, the golf club has an equilibrium line which runs from a point on the underside of the grip at five inches below the butt end through the club center of gravity and extending through the head. The sole surface, within a defined proximity of the sole keel point, is such that even if the club is addressed at different lie angles, between 40-60 degrees, the resulting perceived face angle will be constant within +/−0.5 degrees.

In one embodiment, as shown in FIGS. 5-7, the keel zone preferably has a width ranging from 0.50-0.60 inch in the fore-aft direction, centered on the equilibrium line and a width between 1.00-1.10 inch in the heel-toe direction located by the target lie angle. In this embodiment, the keel zone shape is prismatic to the surface of the sole, with a raised surface that is consistent in the heel-toe direction, and a surface that follows the contours of the club head in the front-aft direction.

The golf club head 20, when designed as a driver, preferably has a volume from 200 cubic centimeters to 600 cubic centimeters, more preferably from 300 cubic centimeters to 500 cubic centimeters, and most preferably from 350 cubic centimeters to 480 cubic centimeters. The volume of the golf club head 20 will also vary between fairway woods (preferably ranging from 3-woods to eleven woods) with smaller volumes than drivers. The golf club head 20 preferably has a mass no more than 225 grams, and most preferably a mass of 180 to 215 grams.

Preferably the golf club head 20 has a body 22 that is composed of titanium, titanium alloy, stainless steel or other iron-alloys. Alternatively, the body 22 may be composed of a lightweight metallic material, such as magnesium alloys, aluminum alloys, magnesium, aluminum or other low density metals.

Another embodiment of the golf club head 20 has a body 22 that is preferably composed of a face component, a body, and a gasket such as disclosed in U.S. Pat. No. 6,964,617, entitled Golf Club Head with Gasket, which is hereby incorporated by reference in its entirety.

Another embodiment of the golf club head 20 is disclosed in U.S. Pat. No. 6,475,100, for a Golf Club Head with Adjustable Face Angle, and is hereby incorporated by reference in its entirety.

FIG. X illustrates a golf club with a closed face angle. The golf club has a club head, a shaft with a grip attached at a butt end of the shaft. The keel zone makes the face angle of the golf club appear consistent at various lie angles.

Figure 1:
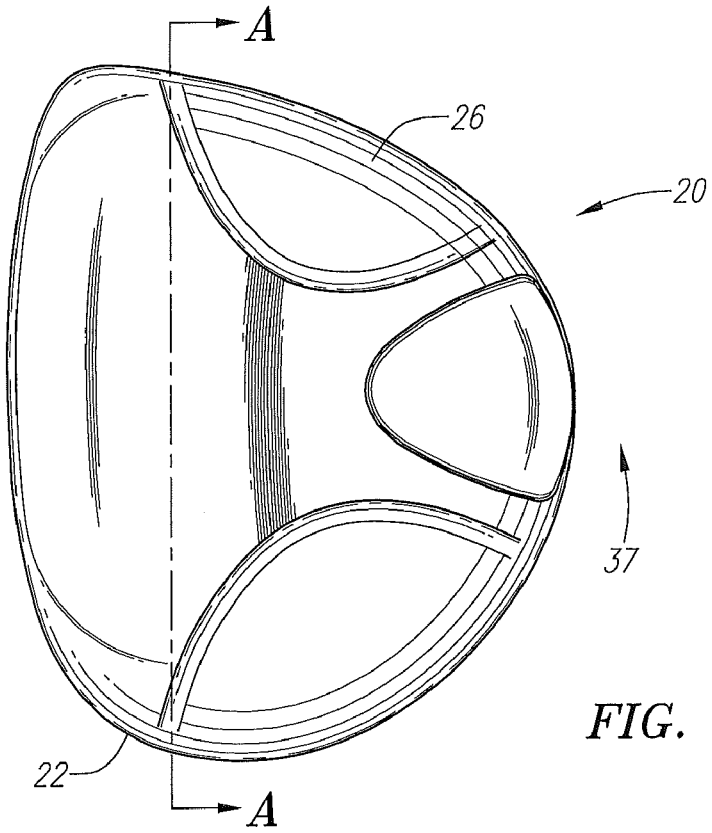
FIG. 1 is a bottom plan view of a golf club head.
Figure 2:
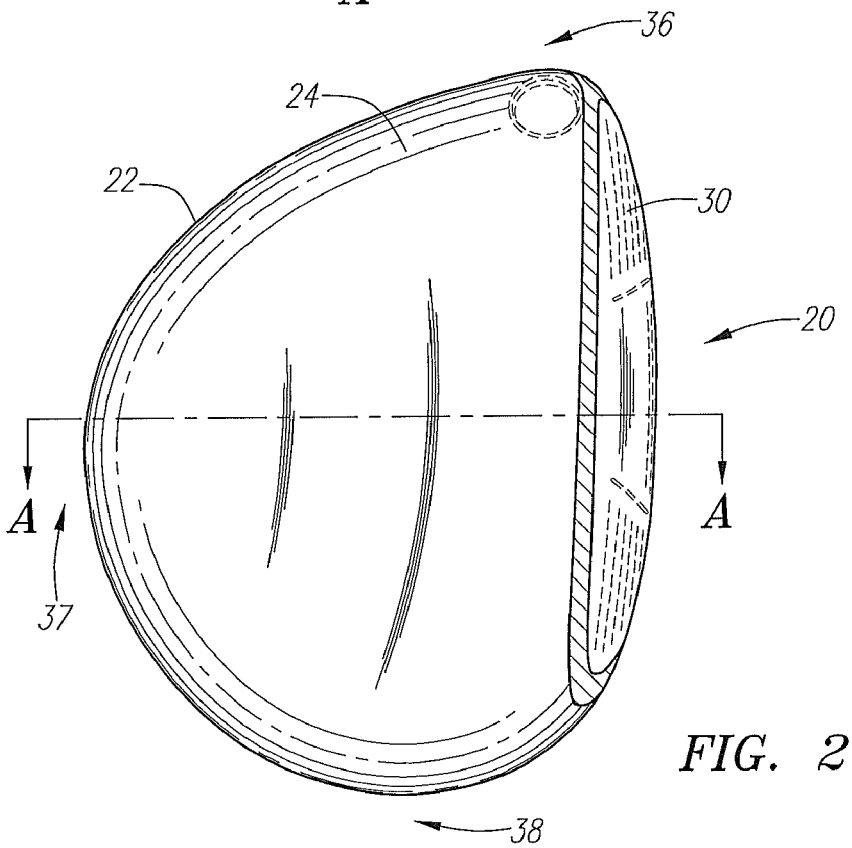
FIG. 2 is a top plan view of a golf club head.
Figure 1A:
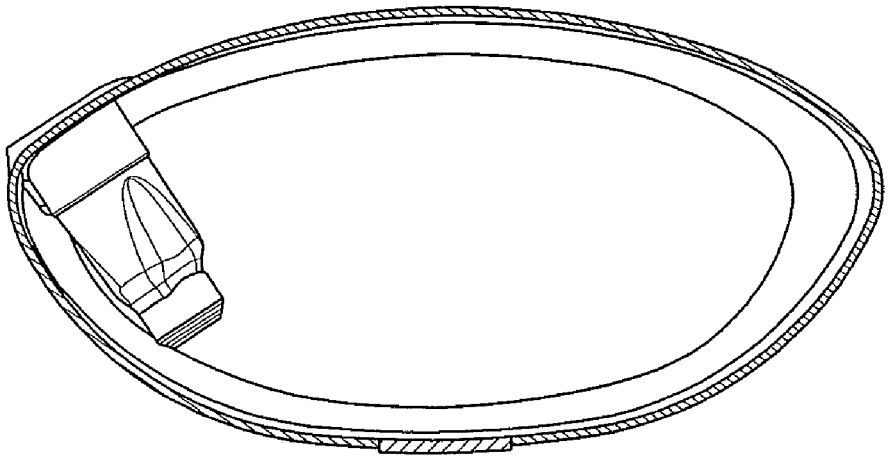
FIG. 1A is a cross-sectional view along line A-A of FIG. 1.
Figure 2A:
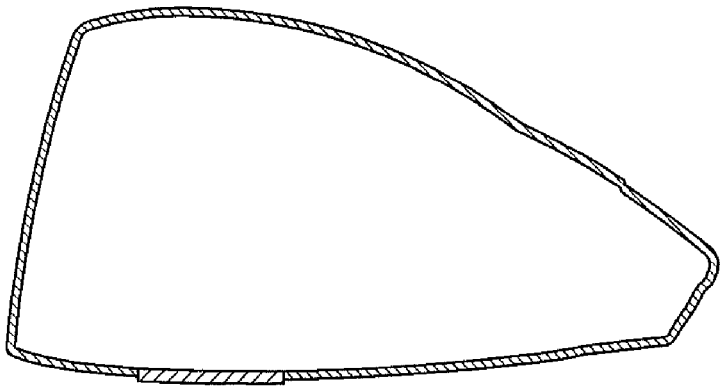
FIG. 2A is a cross-sectional view along line A-A of FIG. 2.
Figure 3:
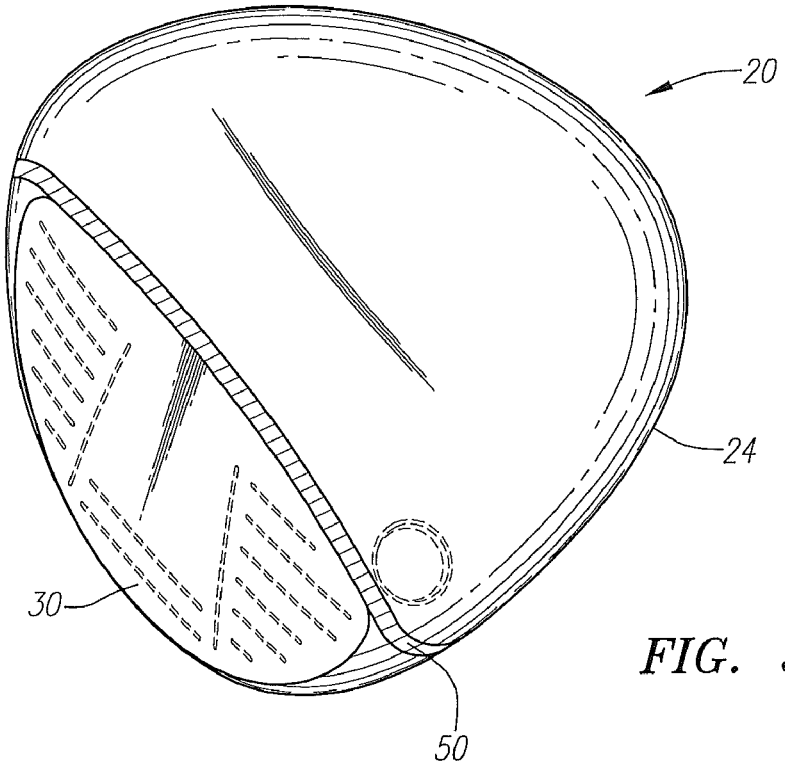
FIG. 3 is a top perspective view of a golf club head.
Figure 4:
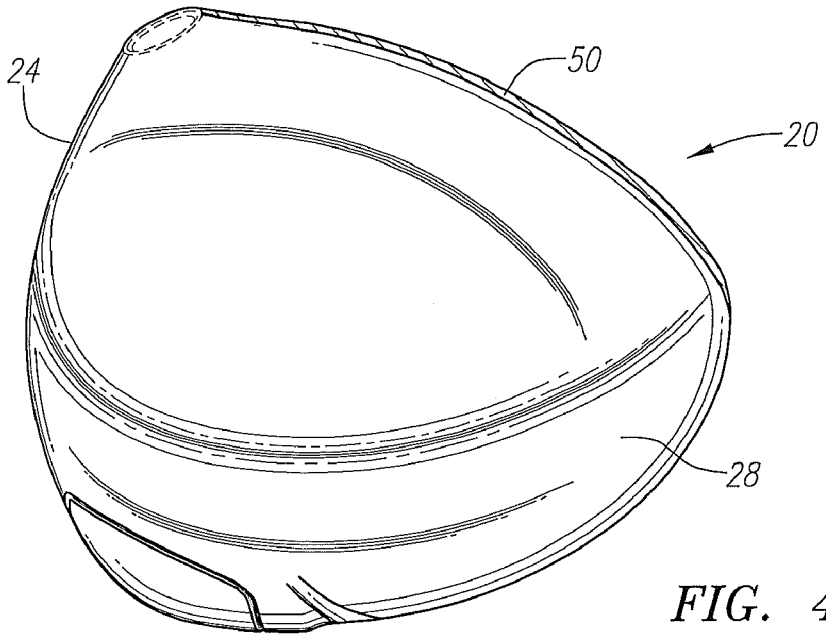
FIG. 4 is a rear view of a golf club head.

FIG. 1(*a*) illustrates a cross-sectional view of the golf club head, with the keel zone. The keel zone has a raised surface that remains consistent in the heel-toe direction. FIG. 2(*a*) illustrates a cross sectional view of the golf club head and keel zone in the fore-aft direction. The keel zone has a raised surface that mimics the surface contours of the sole shape.

In some embodiments, the heel end of the keel zone has a higher raised surface than the toe end. In other embodiments, the toe end of the alignment line has a higher raised surface than the heel end of the alignment line.

TABLE ONE

| | Club Length (Inches) | | | | | | | |
|---|---|---|---|---|---|---|---|---|
| | 40 | 41 | 42 | 43 | 44 | 45 | 46 | 47 |
| Address at lie (Degrees) | 51 | 50 | 49 | 48 | 47 | 46 | 45 | 44 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A wood-type golf club head comprising:

a body having a front portion, a crown portion and a sole portion, the body also having a heel end, a toe end and an aft end, the sole portion having only a single keel point;

a keel zone within the sole located with respect to the center of gravity, having a width ranging from 0.5 inch to 0.6 inch wide fore-aft and 1.0 inch to 1.1 inch wide heel-toe.

2. The golf club according to claim 1 wherein the keel zone is located in the fore-aft direction relative to the equilibrium line.

3. The golf club according to claim 1 wherein the keel zone is located in the heel-toe direction by the target lie angle.

4. The wood-type golf club according to claim 1 wherein the center of the keel zone contacts the ground at the target lie angle and the zone is equally dispersed about the contact point in the heel and toe directions.

5. A wood-type golf club comprising:

a golf club head comprising a body having a front portion, a crown portion and a sole portion, the body also having a heel end, a toe end and an aft end, the sole portion having a single keel point, a keel zone within the sole located with respect to the center of gravity, having a width ranging from 0.5 inch to 0.55 inch wide fore-aft and 1.0 inch to 1.05 inch wide heel-toe;

and a shaft connected to the golf club head;

wherein the keel zone is located in the fore-aft direction relative to the equilibrium line and in the toe-heel direction relative to the target lie angle.

6. The wood-type golf club according to claim 5 wherein the golf club head has a volume ranging from 420 cc to 470 cc.

7. The wood-type golf club according to claim 5 wherein the center of the keel zone contacts the ground at the target lie angle and the zone is equally dispersed about the contact point in the heel and toe directions.

8. A wood-type golf club head comprising:

a body having a front portion, a crown portion and a sole portion, the body also having a heel end, a toe end and an aft end, the sole portion having a single keel point;

a keel zone within the sole located with respect to the center of gravity, having a width ranging from 0.5 inch to 0.55 inch wide fore-aft and 1.0 inch to 1.05 inch wide heel-toe.

9. The wood-type golf club head according to claim 8 wherein the keel zone contacts the ground at the target lie angle and the zone is equally dispersed about the contact point in the heel and toe directions.

* * * * *